US008172332B2

(12) United States Patent
Masunaga et al.

(10) Patent No.: US 8,172,332 B2
(45) Date of Patent: May 8, 2012

(54) CHAIR BACKREST DEVICE

(75) Inventors: Hiroshi Masunaga, Yokohama (JP); Ryo Igarashi, Tokyo (JP); Yoichiro Oda, Yokohama (JP)

(73) Assignee: Okamura Corporation (JP)

( * ) Notice: Subject to any disclaimer, the term of this patent is extended or adjusted under 35 U.S.C. 154(b) by 122 days.

(21) Appl. No.: 12/513,949

(22) PCT Filed: Nov. 9, 2007

(86) PCT No.: PCT/JP2007/071773

§ 371 (c)(1),
(2), (4) Date: May 20, 2009

(87) PCT Pub. No.: WO2008/056762

PCT Pub. Date: May 15, 2008

(65) Prior Publication Data

US 2010/0001572 A1 Jan. 7, 2010

(30) Foreign Application Priority Data

Nov. 10, 2006 (JP) ..... 2006-305987
Nov. 13, 2006 (JP) ..... 2006-306666

(51) Int. Cl.
*A47C 7/02* (2006.01)

(52) U.S. Cl. ..... 297/452.15; 297/452.13; 297/452.56

(58) Field of Classification Search ..... 297/452.13, 297/452.15, 452.56
See application file for complete search history.

(56) References Cited

U.S. PATENT DOCUMENTS 5,102,196 A * 4/1992 Kaneda et al. ..... 297/452.15
5,320,410 A 6/1994 Faiks et al. ..... 297/296
5,997,094 A * 12/1999 Cvek ..... 297/452.15
6,409,268 B1 6/2002 Cvek ..... 297/452.29
D460,300 S 7/2002 Fifield ..... D6/502
6,626,497 B2 * 9/2003 Nagamitsu et al. ..... 297/452.15
6,669,301 B1 * 12/2003 Funk et al. ..... 297/452.63
6,709,060 B1 * 3/2004 Su ..... 297/440.2
6,729,691 B2 * 5/2004 Koepke et al. ..... 297/452.56
7,014,269 B2 * 3/2006 Coffield et al. ..... 297/452.56
7,249,802 B2 * 7/2007 Schmitz et al. ..... 297/452.31

(Continued)

FOREIGN PATENT DOCUMENTS

CA 2 628 209 5/2007

(Continued)

OTHER PUBLICATIONS

International Search Report dated Feb. 19, 2008, issued in corresponding international application No. PCT/JP2007/071773.

(Continued)

*Primary Examiner* — Sarah B McPartlin
(74) *Attorney, Agent, or Firm* — Ostrolenk Faber LLP

(57) ABSTRACT

A backrest device for a chair, capable of, without a reduction in its strength and rigidity, effectively bending backward so as to follow the shape of the back of a person seated on the chair, providing the person with excellent sitting comfort. In the backrest device, a back board is supported by a backrest frame, and the back board has a flexible back stopper on the inner side of a back frame. The thickness of a vertical intermediate section of the back stopper is gradually increased from both left and right sections of the intermediate section toward the center such that the thickness is less in both left and right sections and is maximum at the center.

6 Claims, 9 Drawing Sheets

U.S. PATENT DOCUMENTS

| | | | | |
|---|---|---|---|---|
| 7,270,378 | B2 * | 9/2007 | Wilkerson et al. | 297/452.56 |
| 7,611,199 | B2 * | 11/2009 | Michalak et al. | 297/300.2 |
| 2006/0033369 | A1 | 2/2006 | Eysing | |
| 2009/0020931 | A1 * | 1/2009 | Coffield et al. | 267/142 |
| 2009/0127914 | A1 * | 5/2009 | Igarashi et al. | 297/452.46 |

FOREIGN PATENT DOCUMENTS

| | | |
|---|---|---|
| JP | 2-22154 | 2/1990 |
| JP | 4-15461 | 2/1992 |
| JP | 2001-128785 | 5/2001 |
| JP | 2001-128788 A | 5/2001 |
| JP | 2001-275780 | 10/2001 |
| JP | 2002-125797 | 5/2002 |
| JP | 2004-129966 | 4/2004 |
| JP | 2005-80676 | 3/2005 |
| JP | 2005-160558 | 6/2005 |
| JP | 2005-261569 | 9/2005 |
| KR | 0121505 | 9/1998 |
| WO | WO 2007/052734 | 5/2007 |

OTHER PUBLICATIONS

Supplementary European Search Report dated Mar. 17, 2011.

Office Action dated Jan. 20, 2011 issued in counterpart Korean Patent Application No. 10-2009-7011982.

Japanese Office Action, dated Dec. 6, 2011, issued in corresponding Japanese Patent Application No. 2006-305987, with English translation. Total 3 pages.

* cited by examiner

CHAIR BACKREST DEVICE

CROSS REFERENCE TO RELATED APPLICATIONS

The present application is a 35 U.S.C. §371 National Phase conversion of PCT/JP2007/071773, filed Nov. 9, 2007, which claims benefit of Japanese Application No. 2006-305987, filed Nov. 10, 2006 and Japanese Application No. 2006-306666, filed Nov. 13, 2006, the disclosures of which are incorporated herein by reference. The PCT International Application was published in the Japanese language.

BACKGROUND OF THE INVENTION

The present invention relates to a chair backrest device comprising the flexible back support supporting the back of a sitting person in a backrest frame.

Such a chair backrest device is disclosed, for example, in JP2002-125797A, JP2005-160558A, particularly in FIGS. 10-17, and JP2001-128785A.

In the backrest shell of the backrest device in JP2002-125797A and JP2005-160558A, a number of openings are formed all over the backrest shell, which is flexed rearward when it is pressed by the back of a person. But the thickness of the backrest shell is almost equal, and the whole backrest shell is not effectively flexed rearward along the shape of the back, so that seating comfort is not obtained.

To overcome the disadvantage, the backrest shell can be made thinner for easier flexing, but the backrest shell decreases in strength and rigidity, so that durability is decreased and seating comfort is likely to get worse due to too much flexing.

In the backrest device in JP2001-128785A, in the upper part of the backrest shell, there are two vertically elongate openings which engage with the projections on the upper part of the backrest frame to enable the backrest shell to move up and down. Furthermore, in the lower part of the backrest frame, there are holding portions projecting forward and having grooves. On the backrest shell, there are lobes which engage with the holding portions and which is pressed downward on the grooves, so that the backrest shell is supported by the backrest frame to enable the backrest shell to flex rearward.

However, in the support structure for the backrest shell, the right and left sides of the backrest shell supported by the backrest frame does not turn around a vertical axis, so that the whole backrest shell does not flex rearward effectively along the shape of the back of a person.

SUMMARY OF THE INVENTION

In view of the disadvantages, it is an object of the invention to provide a chair backrest device in which a backrest shell can flex effectively along the shape of the back of a person without decreasing strength and rigidity of the backrest shell, the device providing seating comfort.

DETAILED DESCRIPTION OF PREFERRED EMBODIMENTS

One embodiment of the present invention will be described with respect to drawings.

Figure 1:
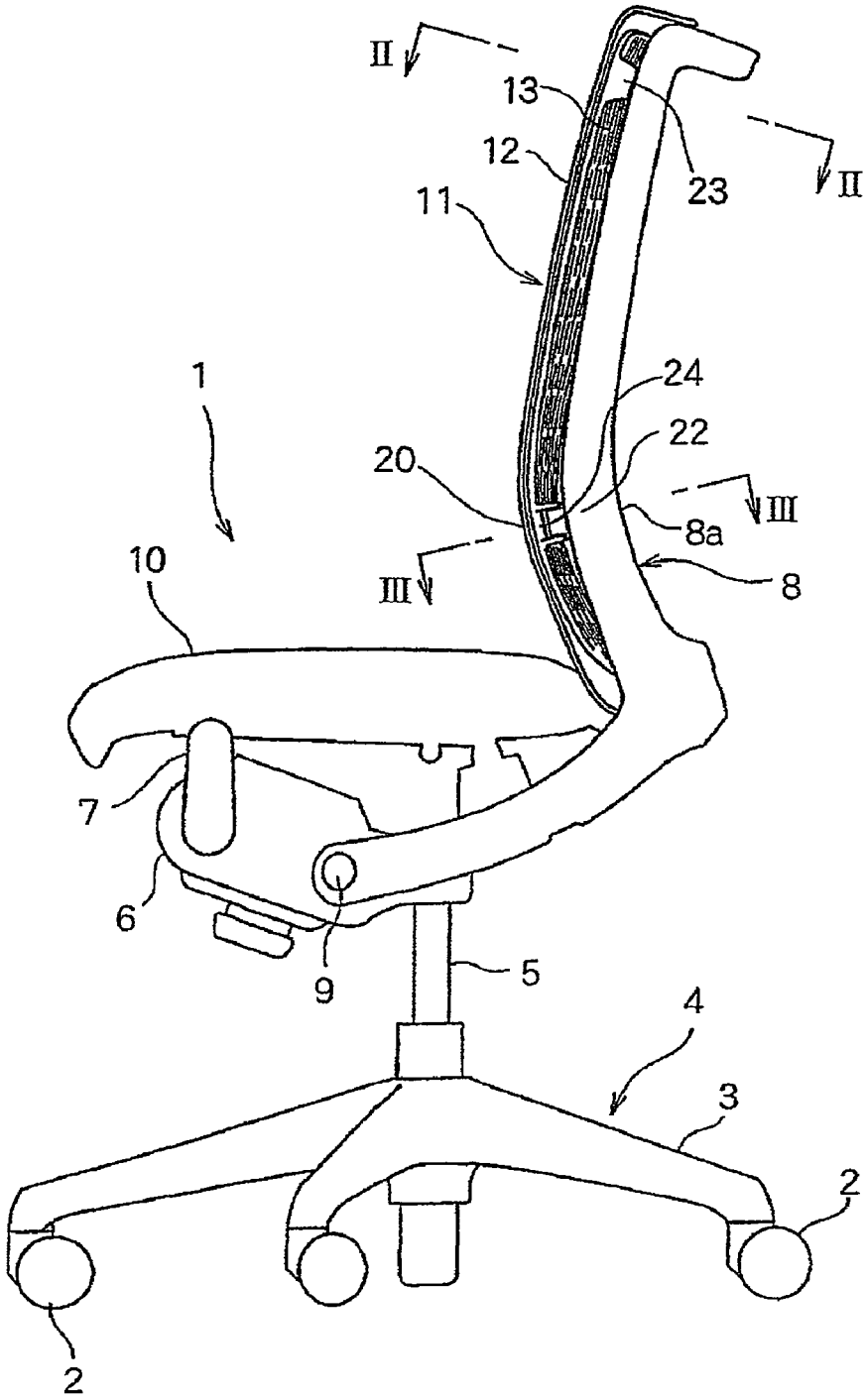
FIG. 1 is a side elevational view of a chair comprising a backrest device according to the present invention.
Figure 2:
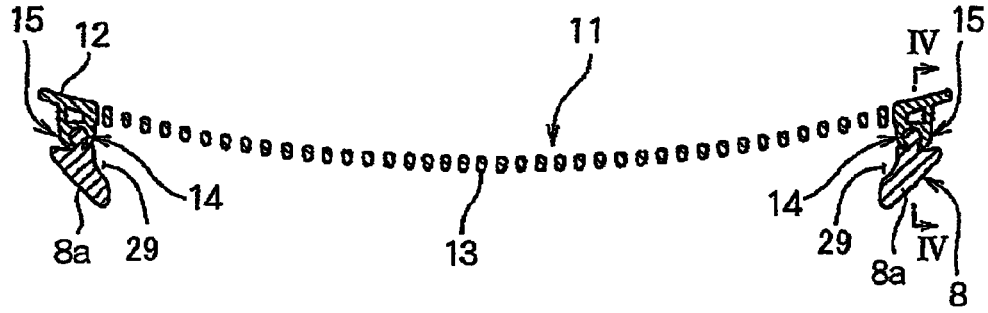
FIG. 2 is an enlarged horizontal sectional end view taken along the line II-II in FIG. 1.
Figure 3:
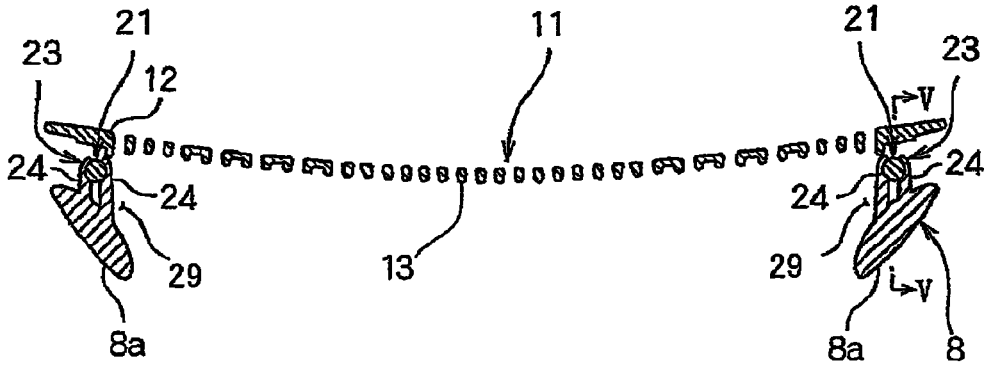
FIG. 3 is an enlarged horizontal sectional end view taken along the line III-III in FIG. 1.
Figure 4:
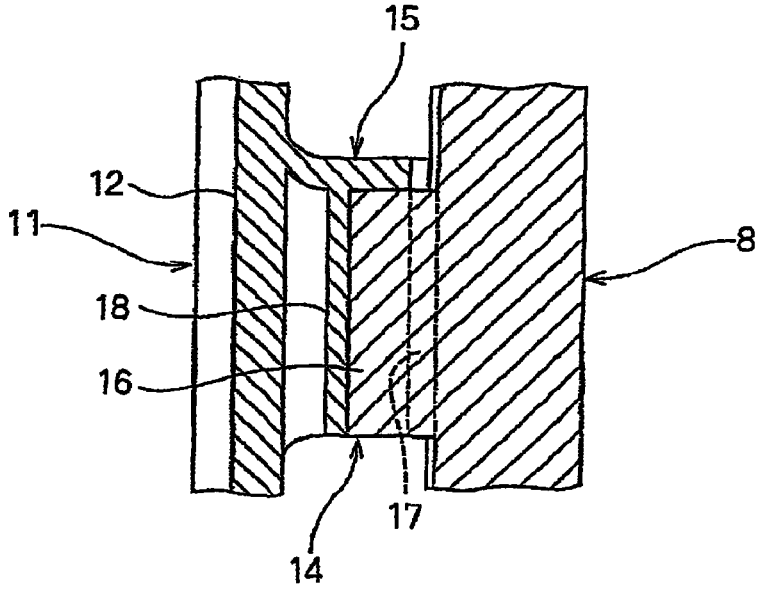
FIG. 4 is an enlarged vertical sectional side view taken along the line IV-IV in FIG. 2.
Figure 5:
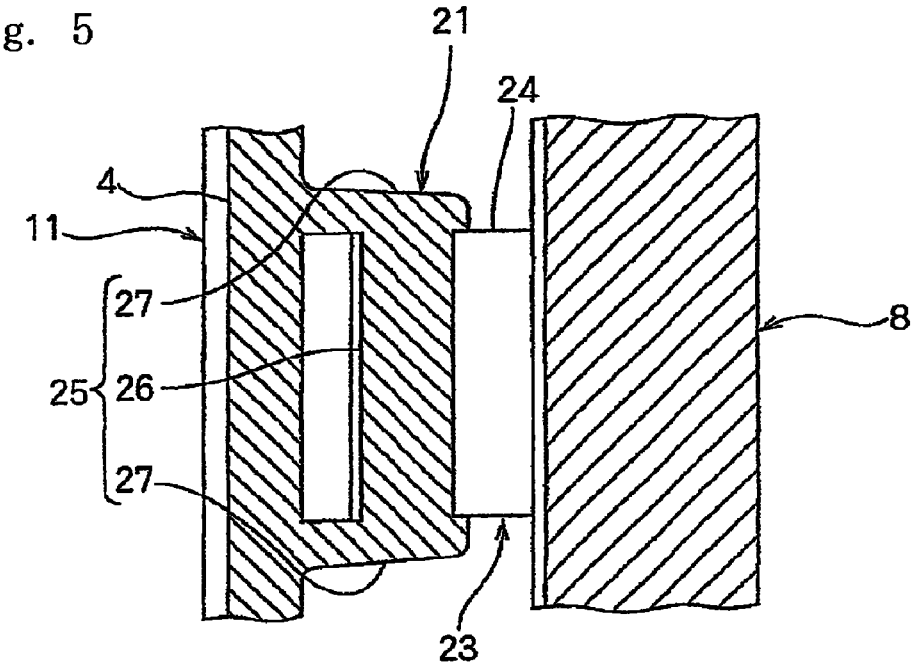
FIG. 5 is an enlarged vertical sectional side view taken along the lien V-V in FIG. 3.

FIG. 1 is a side elevational view of a chair comprising a chair backrest device according to the present invention. FIG. 2 is an enlarged horizontal sectional end view taken along the line II-II in FIG. 1; and FIG. 3 is an enlarged horizontal sectional end view taken along the line III-III in FIG. 1.

A chair 1 comprises a leg unit 4 having five radially-extending legs 3 each of which has a caster 2 at the end; a post 5 standing at the center of the leg unit 4 and retractable with a gas spring (not shown); and a base 6 fixed at the upper end of the post 5.

A seat support frame 7 is mounted at the lower end to the front end of the base 6. To the base 6, the front ends of side frames 8*a* of a backrest frame 8 are pivotally mounted on a pivot shaft 9. The backrest frame 8 is always urged forward and downward by urging means (not shown) within the base 6.

A seat 10 is supported at the front end by the seat support frame 7 and at the rear end by the side frames 8*a*.

A backrest shell 11 is mounted over the front face of the side frames 8*a* of the backrest frame 8.

Figure 9:
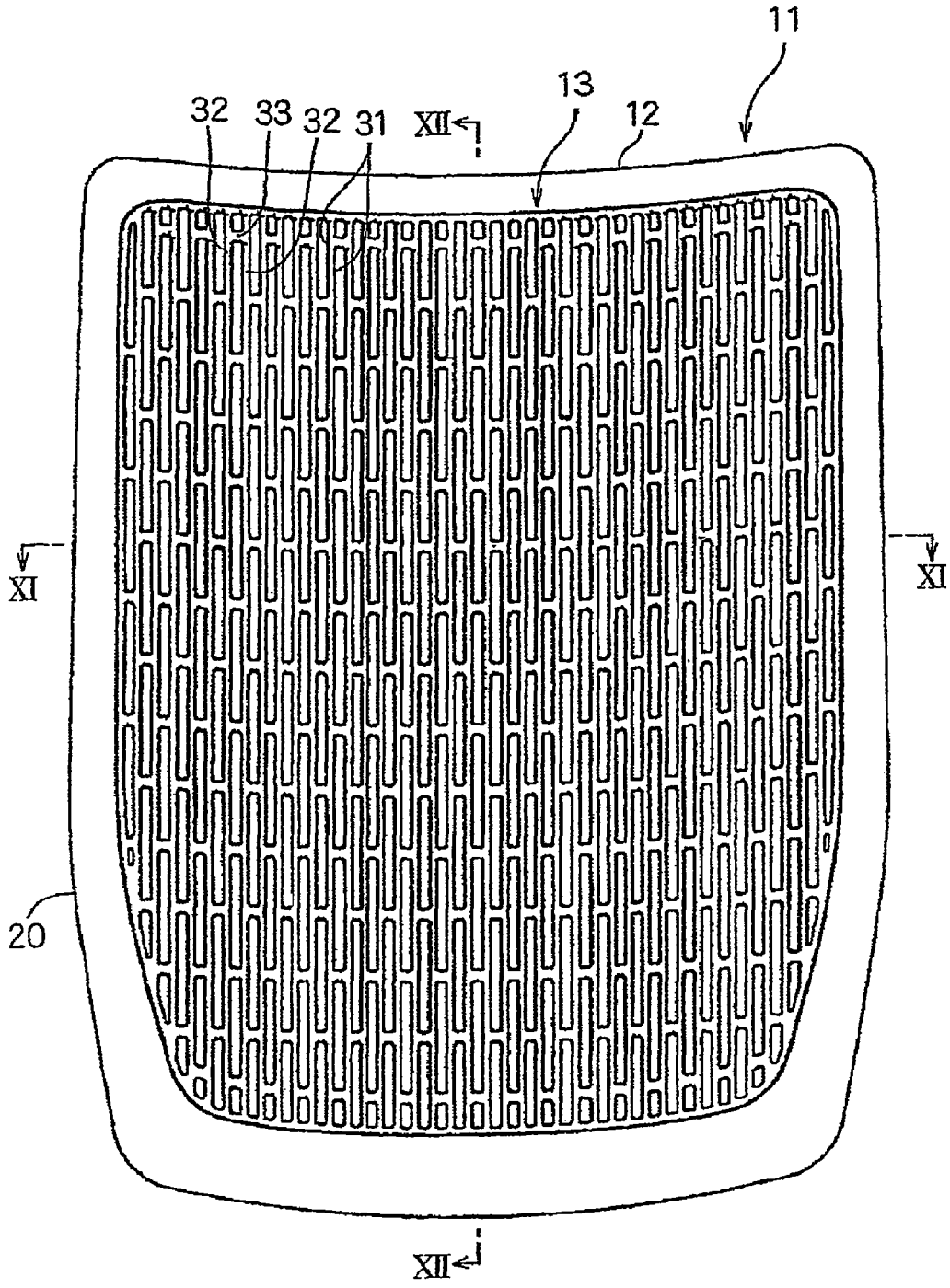
FIG. 9 is a front elevational view of the backrest shell.
Figure 10:
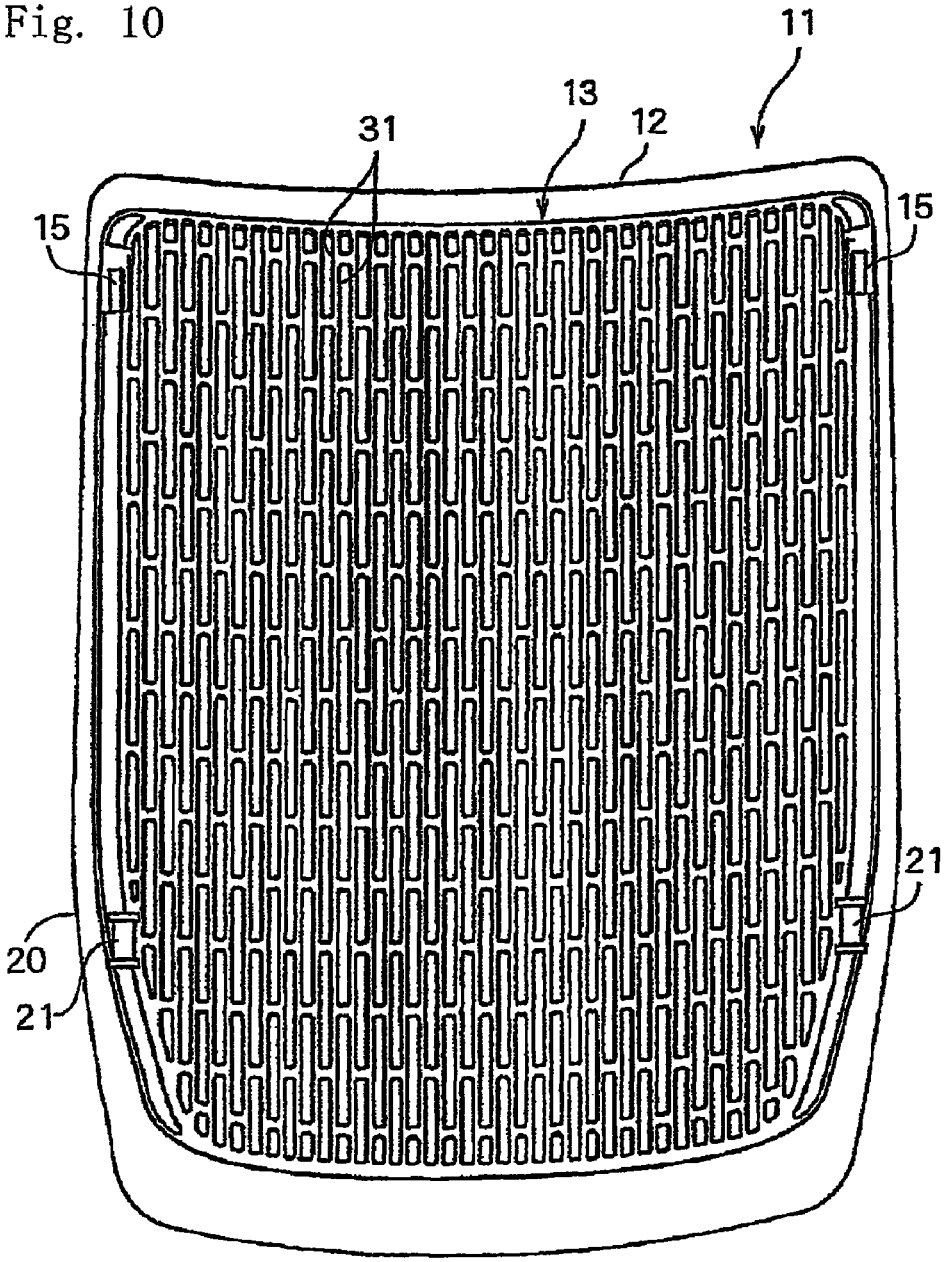
FIG. 10 is a rear elevational view thereof.

In FIGS. 9 and 10, the backrest shell 11 comprises a rectangular high-rigidity back frame 12 and a flexible back support 13, and is integrally molded from synthetic resin.

The backrest frame 8 and the backrest shell 11 are bent such that the upper part projects slightly more than the lower part in FIG. 1.

A distance between the side frames 8*a* and 8*a* of the backrest frame 8 becomes narrower rearward.

In FIGS. 1, 2, 4 and 6, the first projecting portion 14 is provided on the front face at the upper end of each of the side frame 8*a*, while the first receiving portion 15 is formed on the rear face at the lower end of the back frame 12. The first projecting portions 14,14 are fitted in the first receiving portions 15,15 upward, so that the rear face of the back frame 12 is supported by the front faces of the side frames 8,8.

Figure 6:
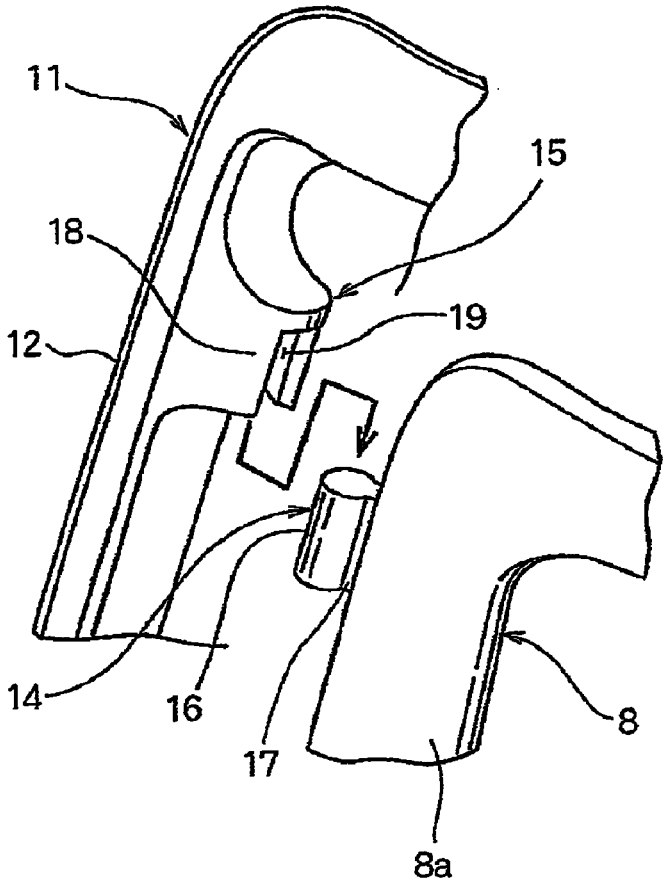
FIG. 6 is an exploded perspective view of a connector between a backrest frame and a backrest shell at the upper end.

In FIG. 6, the first projecting portion 14 comprises a first shaft 16 and a support 17, and projects forward on the front face at the upper end of the side frame 8*a*.

The first receiving portion 15 is formed by closing the upper end of a C-like sectioned tube 18 that is open as a slit at the rear end. The first shaft 16 of the first projecting portion 14 is fitted in the tube 18 of the first receiving portion 15 upward and the support 17 is fitted in the tube 18, so that the first shaft 16 is fitted in the tube 18 to turn around a vertical axis.

In FIGS. 1, 3, 5 and 7, on the back face at the side of a bent portion 20 of the back frame 12, a second projecting portion 21 is provided, while a second receiving portion 23 is provided at a bent portion 22 of the side frame 8*a*. The second projecting portions 21, 21 engages in the second receiving portions 23,23, so that the back frame 12 of the backrest shell 11 is supported at the bent portions 20,22.

Figure 7:
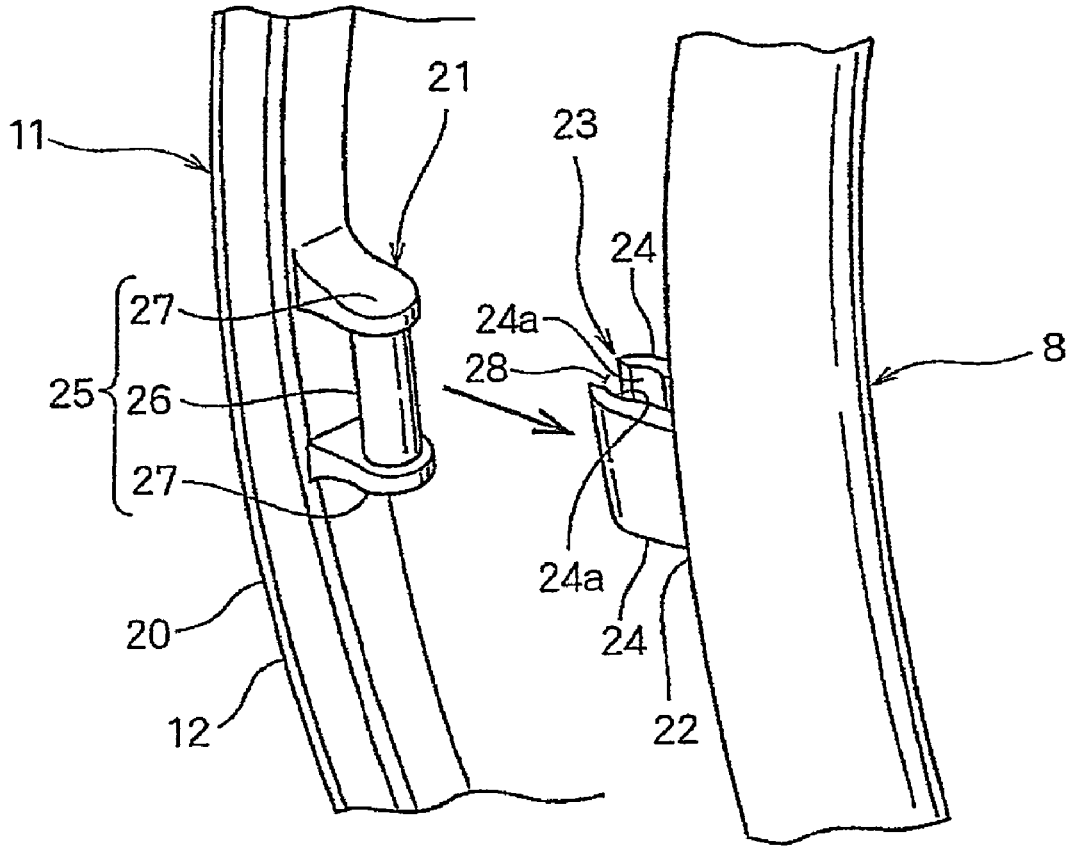
FIG. 7 is an exploded perspective view of a connector at the lower part.

In FIG. 7, the second receiving portion 23 comprises a pair of projections 24,24 spaced from each other. Inner surfaces 24*a*,24*a* of the projections 24,24 are concavely formed.

The second shaft 25 of the second projecting portion 21 comprises a shaft body 26 slightly longer than the projections 24,24 and a pair of upper and lower horizontal portions 27,27 slightly larger than a diameter of the shaft body 26.

The shaft body 26 of the second projecting portion 21 is pressed onto an opening 28 between the projections 24 and 24 of the second receiving portion 23 to make the opening 28 open elastically. Thus, the shaft body 26 fits between the opposing inner surfaces 24*a* and 24*a*, and the second shaft 25 of the second projecting portion 21 engages in the second receiving portion 23 to turn around a vertical axis.

Figure 8C:
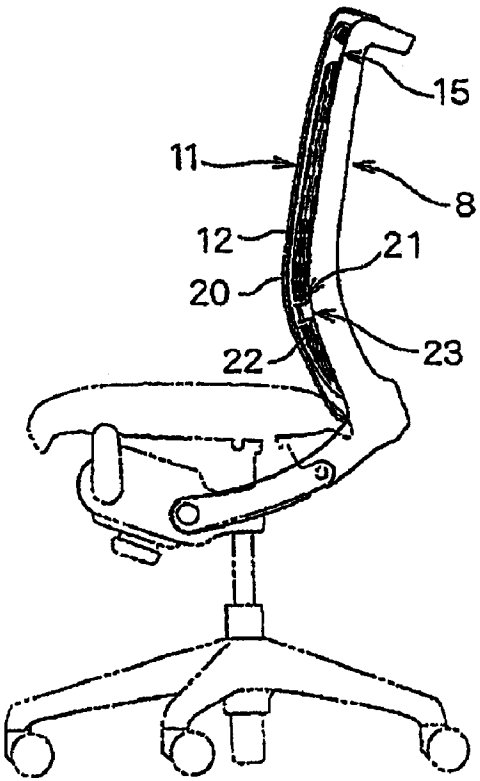
FIGS. 8A-8C are views showing how to support the backrest shell over the backrest frame.
Figure 8B:
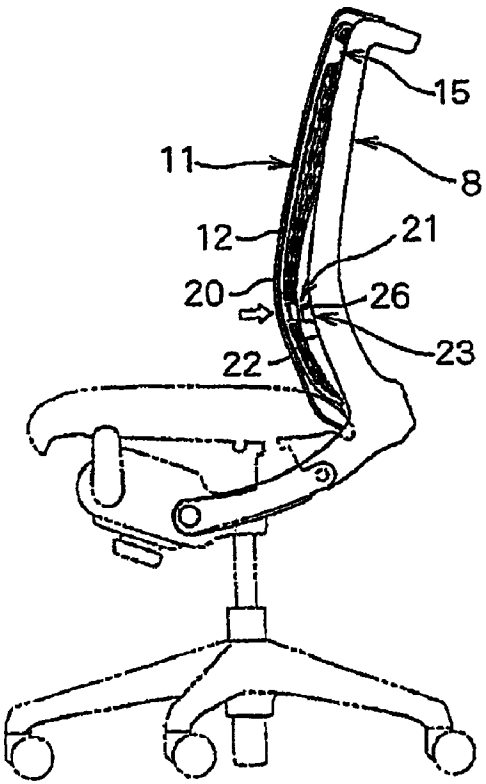
Figure 8A:
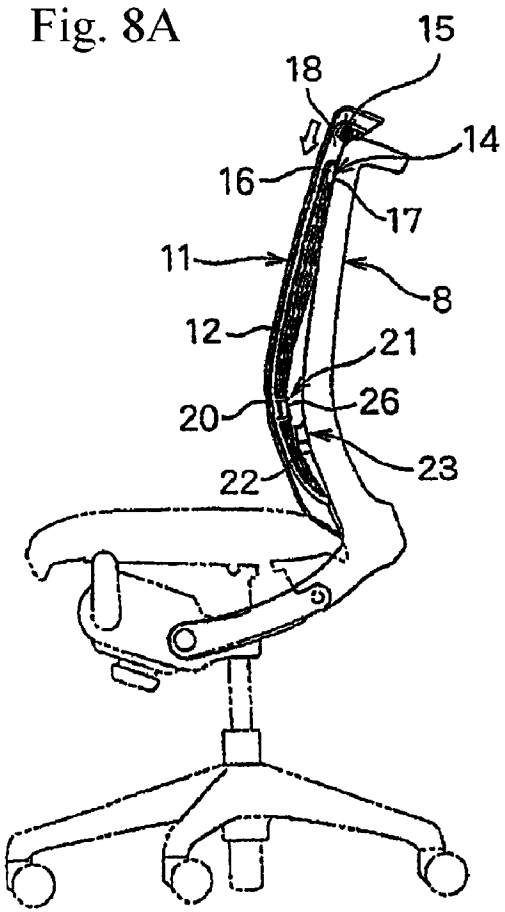

FIGS. 8A-8C show how the backrest shell 11 is supported by the backrest frame 8.

In FIGS. 8A and 6, the backrest shell 11 is moved downward. The first shaft 16 of the first projecting portion 14 engages in the tube 18 of the first receiving portion 15, while the support 17 that fixes the first shaft 16 to the side frame 8*a* fits into the opening 19 of the tube 18.

Then, in FIGS. 8B and 7, the shaft 26 of the second projecting portion 21 at the bent portion 20 of the back frame 12 is pressed rearward into the opening 28 between the projections 24 and 24 of the second receiving portion 23 at the bent portion 22 of the side frame 8*a*, and makes the opening 28 open to engage between the projections 24 and 24.

Accordingly, in FIG. 8C, the backrest shell 11 is supported to turn around the vertical axis with sufficient strength at four points at the upper ends and the bent portions 22 of the side frames 8*a* of the backrest frame 8.

In FIGS. 2 and 3, after the backrest shell 11 is mounted, there is formed a space 29 where each side portion of the back support 13 can be flexed rearward, between the rear face of the side of the back support 13 and the front face of the side frame 8*a*.

Then, the backrest shell 11 will be described in detail in FIGS. 9-14.

Two vertical ribs 30,30 project on the rear surfaces of the side of the back frame 12 of the backrest shell 11.

A plurality of vertical slits 31 are formed at regular intervals all over the surface of the back support 13. The horizontally-adjacent slits 31 are staggered by a half of the length of the slit 31 horizontally. The slits 31 are in line vertically.

By the arrangement of the slits 31, webs between the slits 31 are staggered horizontally and are not in line. A number of slits 31 do not cause the back support 13 to decrease in strength.

Figure 11:
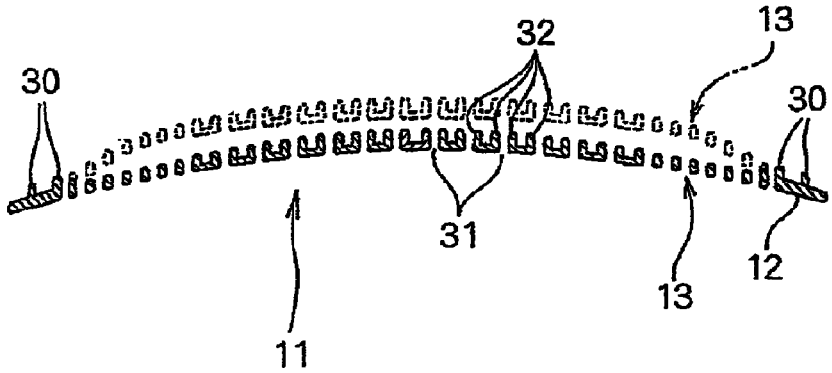
FIG. 11 is an enlarged horizontal sectional end view taken along the line XI-XI in FIG. 9.
Figure 12:
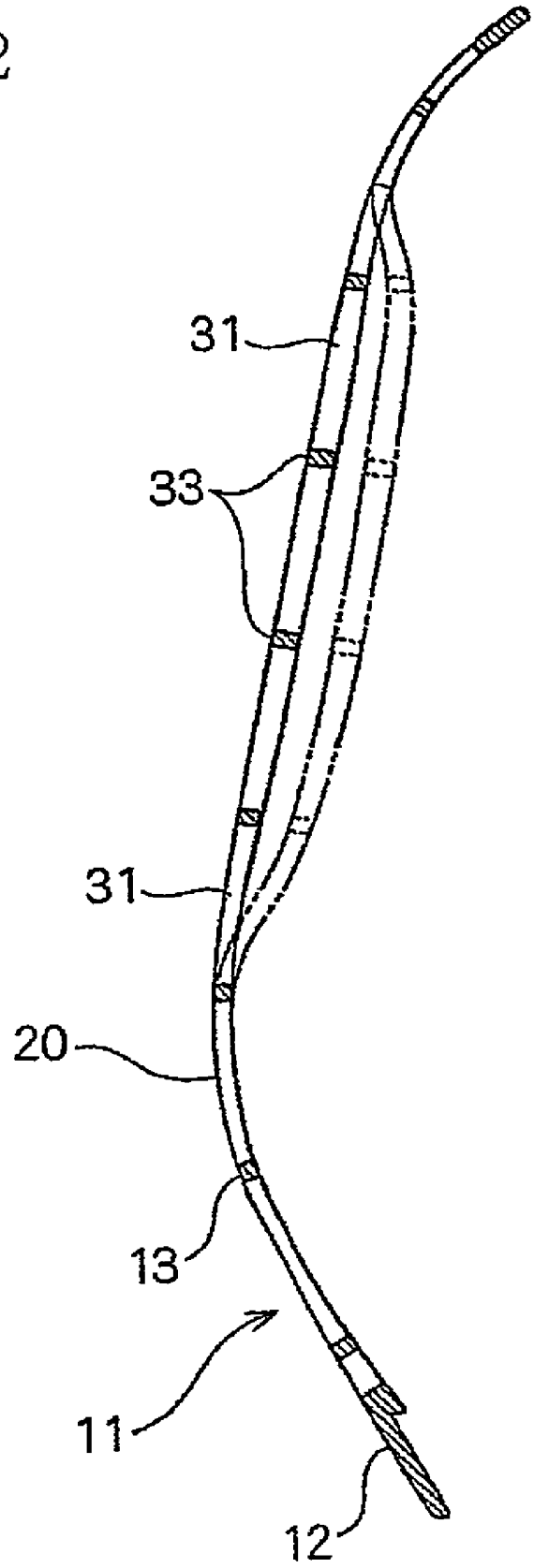
FIG. 12 is an enlarged horizontal sectional end view taken along the line VII-XII in FIG. 9.

In FIG. 11, the back support 13 is the thickest in the middle of the width and gradually decreases toward the side ends horizontally, while the back support 13 is the thickest in the middle of the vertical length and gradually decreases toward the upper and lower ends vertically in FIG. 12.

Figure 13:
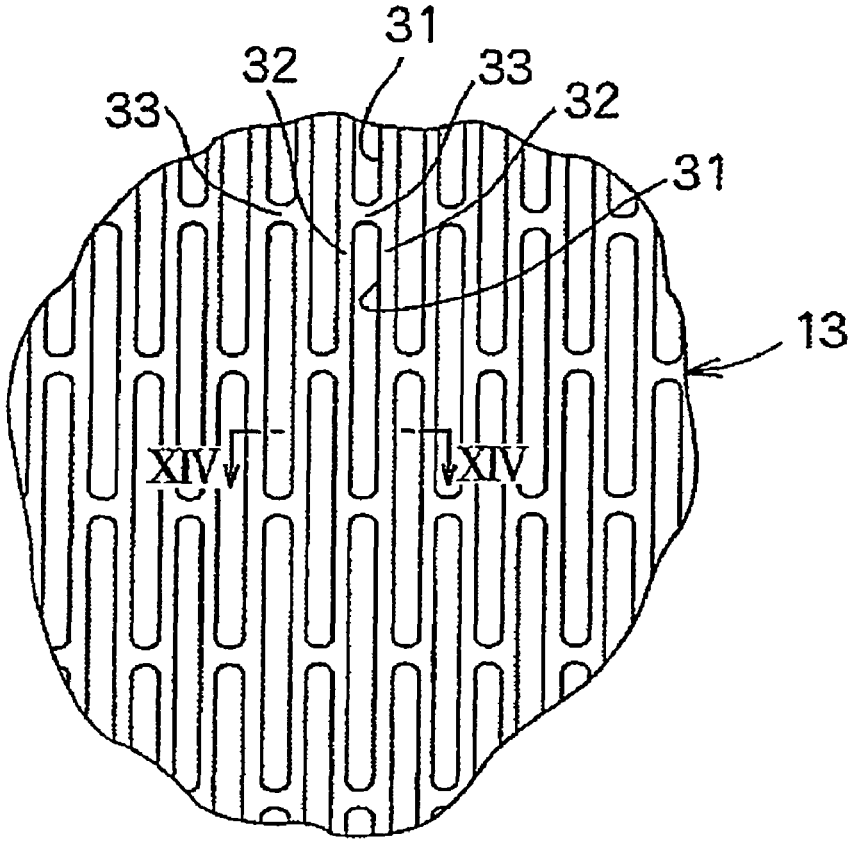
FIG. 13 is an enlarged front view of a back support.
Figure 14:
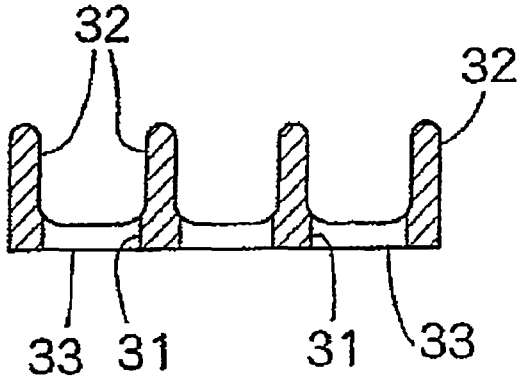
FIG. 14 is an enlarged horizontal sectional plan view taken along the line XIV-XIV in FIG. 13.

In FIGS. 13 and 14, the back support 13 has rectangular-sectioned vertically-extending ribs 32 on the back surface and thus has U-like horizontal cross section in FIG. 11. The slit 31 is formed along thinner portion 33 between the adjacent ribs 32.

As described above, in the foregoing embodiments, the back support 13 which is pressed by the back of a person is the thickest in the middle of the width and gradually reduces in thickness toward the right and left side ends, so that flexing rigidity is the highest in the middle to allow the right and left sides to flex more easily than the middle as shown in two-dot-dash lines in FIG. 11. Thus, the middle of the back support 13 flexes along the shape of the back of the person, so that the whole back is stably supported providing seating comfort.

The back support 13 is the thickest in the middle of the length to increase flexing rigidity. The middle onto which the back is pressed strongly is prevented from flexing excessively rearward like a convex as shown by tow-dot-dash lines in FIG. 12. The middle of the back is comfortably supported, and the back support 13 is unlikely to decrease in strength.

A number of rectangular sectioned ribs 32 project on the rear surface of the back support 13 and extend vertically. Thus, the back support 13 increases in bending rigidity along the thickness perpendicular to the width. In spite of a number of slits, the back support 13 improves in strength. The back support 13 has U-like horizontal cross sections, and the slits 31 are formed along the thinner portions 33 between the adjacent ribs 32. Accordingly, the back support 13 opens rearward in the rear surface around the slits 31 and can be easily flexed rearward.

The present invention is not limited to the foregoing embodiments.

In the embodiment, the adjacent slits 31 in the back support 13 are staggered horizontally, but may be formed to be in line with each other. Different-length slits may be formed.

Without the slits as above, the back support may be formed with different thickness similar to the embodiment.

What is claimed is:

1. A chair backrest device comprising:

a backrest frame; and a backrest shell supported by the backrest frame, the backrest shell comprising:

a back frame, and a flexible back support positioned within the back frame, the flexible back support having a widthwise direction and being thickest in a middle in the widthwise direction and gradually getting thinner horizontally from the middle toward each side, wherein the back support comprises a plurality of vertically elongate slits comprising slits formed vertically in the back support, wherein the back support comprises a rear surface comprising a plurality of rectangular ribs positioned at the rear surface of the back support along a length of the back support, such that the slits are formed in and along a thinner portion between adjacent ribs of the plurality of rectangular ribs.

2. The chair backrest device of claim 1, wherein the slits of the plurality of slits are staggered horizontally.

3. A chair backrest device comprising:

a backrest frame; and a backrest shell supported by the backrest frame, the backrest shell comprising:

a back frame, and a flexible back support positioned within the back frame, the flexible back support having a widthwise direction and being thickest in a middle in the widthwise direction and gradually getting thinner horizontally from the middle toward each side, wherein the backrest frame and the back frame are tilted at an upper part more rearward than a lower part to form a bent portion between the upper part and the lower part, the back frame being supported by the backrest frame to pivot around a vertical axis at the bent portion and at an upper end.

4. The chair backrest device of claim 3, further comprising:

a receiving portion positioned at the bent portion and the upper end of one of the back frame and the backrest frame; and a shaft positioned at the bent portion and the upper end of the other, the shaft fitting in the receiving portion so as to enable the back frame to be supported by the backrest frame pivotally.

5. The chair backrest device of claim 3, wherein the backrest frame comprises a side frame, and the back support comprises a side positioned such that a space is formed between the side of the back support and the side frame of the backrest frame, the space configured to allow the side of the back support to flex rearward.

6. The chair backrest device of claim 5, wherein the side frame comprises an inner side that is bent inward and rearward, and the space is provided close to the inner side of the side frame.

* * * * *